US005720550A

United States Patent [19]

Akiyama et al.

[11] Patent Number: 5,720,550

[45] Date of Patent: Feb. 24, 1998

[54] VOLUME REDUCER FOR POWDER MATERIAL

[75] Inventors: Seizaburo Akiyama, Tsuduki-Gun; Masasi Kato, Ibaraki, both of Japan

[73] Assignee: Hosokawa Micron Corporation, Osaka, Japan

[21] Appl. No.: 678,158

[22] Filed: Jul. 11, 1996

[30] Foreign Application Priority Data

Aug. 24, 1995 [JP] Japan ..... 7-216281

[51] Int. Cl.[6] ..... B65G 29/02

[52] U.S. Cl. ..... 366/139; 366/191; 55/302; 55/401; 55/409; 55/431

[58] Field of Search ..... 366/101, 102, 366/103, 105, 139, 191, 194–196; 55/302, 401, 405, 409, 431, 472

[56] References Cited

U.S. PATENT DOCUMENTS

| | | | |
|---|---|---|---|
| 1,292,561 | 1/1919 | Baldwin | 55/401 |
| 3,897,218 | 7/1975 | Busweiler | 366/139 X |

FOREIGN PATENT DOCUMENTS

| | | |
|---|---|---|
| 51-39331 | 9/1976 | Japan . |
| 56-37121 | 8/1981 | Japan . |
| 58-3938 | 1/1983 | Japan . |
| 2-139830 | 11/1990 | Japan . |
| 7-41715 | 9/1995 | Japan . |

*Primary Examiner*—Charles E. Cooley
*Attorney, Agent, or Firm*—Brinks Hofer Gilson & Lione

[57] ABSTRACT

A volume reducer for reducing the volume of a powder material by removal of some air has a cylindrical casing having an inlet and an outlet for letting powder material in and out. In the casing, a rotor rotatable on the center axis of the casing is provided. The rotor has a cylindrically formed porous plate and a plurality of inner and outer chambers formed in the inside and outside of the porous plate. The outer chambers are loaded with the powder material. A rotary valve that rotates together with the rotor is provided. The rotary valve has a plurality of ventilation openings communicating with the respective inner chambers in an axial direction. The rotary valve is embraced in a stationary valve. The stationary valve has a cavity that communicates with a ventilation opening when the rotary valve is positioned within a predetermined range of its rotation angle. The stationary valve has a compressed air injection opening with which the ventilation opening communicates.

9 Claims, 10 Drawing Sheets

VOLUME REDUCER FOR POWDER MATERIAL

BACKGROUND OF THE INVENTION

1. Field of the Invention

The present invention relates to a volume reducer for reducing volume of powder material by removing air contained therein.

2. Description of the Prior Art

A volume reducer of this type is used to reduce volume of powder material, when a large amount of such material is dealt with, by removing part of air contained in the material so that the material can be loaded with reduced volume into a bag or container. The volume reducer is also used, for example, in a dust collector to transfer dust to a desired location.

Japanese Published Patent No. S56-37121 discloses a rotary valve applied as a means for transferring powder material (rotary feeder). With reference to FIGS. 1 and 2, the rotary feeder of this publication will be described below.

As shown in FIGS. 1 and 2, the rotor 2, together with a hollow-bodied axle cylinder 3, rotor blades 4 and an outer drum 11, forms six chambers. The ends of the rotor blades 4 are protruded from the outer drum 11, so that powder material is conveyed along the casing 1 until discharged downward. The outer drum 11 is provided with a large number of pores 12. When a negative pressure is applied to the drum 11 through a pipe 8, which is connected to a pump (not shown in the figure), the air contained in the powder material flows through the pores 12 into the rotor 2. The air then flows through pores 10 provided on the axle cylinder 3 into the cylinder 3, and sucked, through the axle cylinder 3 and the pipe 8, into the pump.

As a result, the powder material, which is fed to an inlet 19 from above, easily enters the inlet 19, and, while the material is conveyed clockwise with the rotation of the rotor 2, the air contained in the material is removed. The pores 10 that are positioned in their lowest position by rotation are stopped up by a valve member 21, so that air removal does not take place in this position.

On the other hand, the rotor 2 has a plurality of communicating openings 15 on its left side surface. The communicating openings 15 are usually not open because they are obstructed by a part of the casing 1, except when one is in its lowest position, where a ventilation opening 17 is provided on the casing 1. In the lowest position, where one of the ventilation opening 17 coincides in position with the communication opening 15, air flows into the chamber inside the rotor from outside through holes 18 on a bearing cover 7. The thus admitted air, after flowing through the pores 12 on the outer drum 11, acts to blow down the powder material that is conveyed down to the lowest position, making the discharge of the material easier.

However, the conventional structure as described above is defective in the following respects. First, in order to achieve satisfactory air removal, the rotation speed of the rotor 2 needs to be reduced. This also reduces centrifugal force that acts on the powder material, and accordingly reduces the force that causes the powder material to fall at the discharge (lowest) position. As a result, since the air pressure provided from outside is not sufficient for satisfactory discharge, part of the powder material is deposited on the rotor 2. Secondly, in this conventional structure, the pores 10 need to be sealed with the valve member 21 when they are in the discharge position. The sealing, however, is liable to be incomplete.

Thirdly, the discharge pressure is constant because it depends on the supplied air pressure. It is therefore impossible to adjust the discharge pressure according to the type of powder material.

Further, the conventional apparatus described above (Japanese Published Patent No. S56-37121) is an invention with the object of supplying powder material from a low-pressure field to a high-pressure field in a compressed-air pressure feed line, and therefore its performance is not sufficient for the purpose of reducing volume of powder material. For example, with some type of valve member 21, sealing is effective enough as long as the suction force is kept moderate. When a higher suction force is applied, however, the sealing is not effective enough to obtain a pressure (about −4,000 $mmH_2O$) that is required to remove the air contained in the powder material fed into the chamber inside the rotor. It is therefore impossible to perform sufficient air removal.

SUMMARY OF THE INVENTION

An object of the present invention is to provide a volume reducer with a simple, reliable mechanism.

To achieve the above object, a volume reducer according to the present invention is provided with a cylindrical casing having at its top an inlet for letting in powder material and having at its bottom an outlet for letting out the powder material; a rotor rotatable on a center axis of said casing, provided with a cylindrically formed porous plate and a plurality of inner and outer chambers formed by radially separating space inside and outside the said porous plate, the outer chambers being loaded with the powder material; a rotary valve rotatable together with said rotor, provided with a plurality of ventilation openings communicating with inner chambers in an axial direction; a stationary valve embracing said rotary valve in such a way that the rotary valve rotates sliding in absolute contact with said stationary valve, provided with a cavity communicating with said ventilation openings when said rotary valve is positioned within a predetermined range of its rotation angle, and provided with an exhaust opening for connecting said cavity to outside; and a compressed air injection opening provided on said stationary valve for receiving compressed air from outside and for communicating with one of the ventilation openings when the ventilation opening is rotated to a position corresponding to said outlet.

In the structure described above, the powder material, when conveyed to the discharge position after air removal, receives forces not only from its own weight and centrifugal force but also from compressed air to be pressed out of the outer chamber. Consequently, the powder material is released without leaving deposit.

BRIEF DESCRIPTION OF THE DRAWINGS

This and other objects and features of this invention will become clear from the following description, taken in conjunction with the preferred embodiments with reference to the accompanying drawings in which.

DESCRIPTION OF THE PREFERRED EMBODIMENTS

Figure 1:
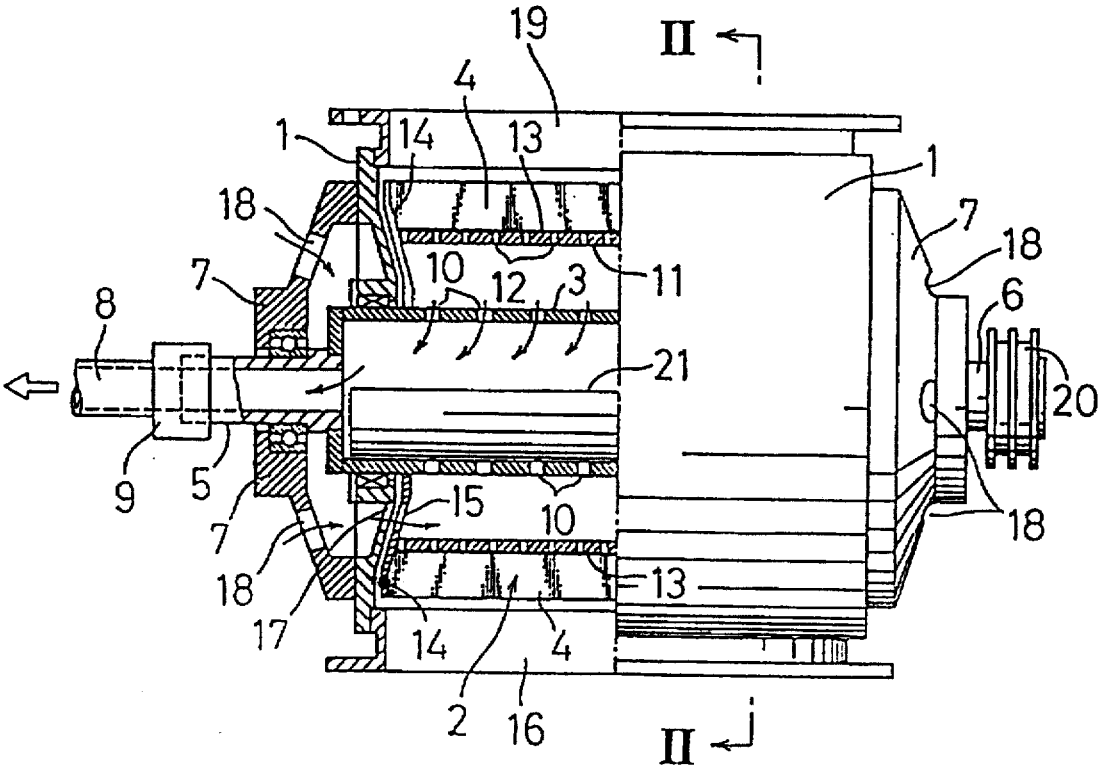
FIG. 1 PRIOR ART
FIG. 1 is a partly cross-sectional and partly external view of a conventional volume reducer.
Figure 2:
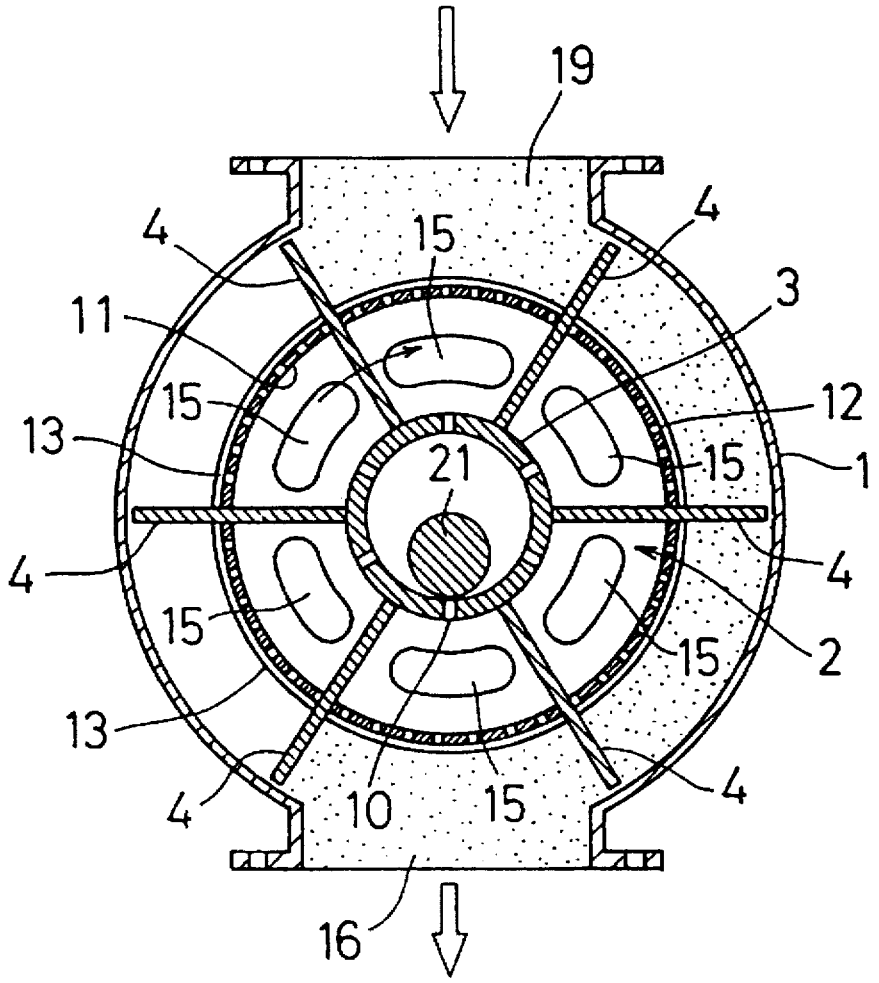
FIG. 2 PRIOR ART
FIG. 2 is a cross-sectional view taken along line II—II shown in FIG. 1 of the conventional volume reducer shown in FIG. 1.
Figure 3:
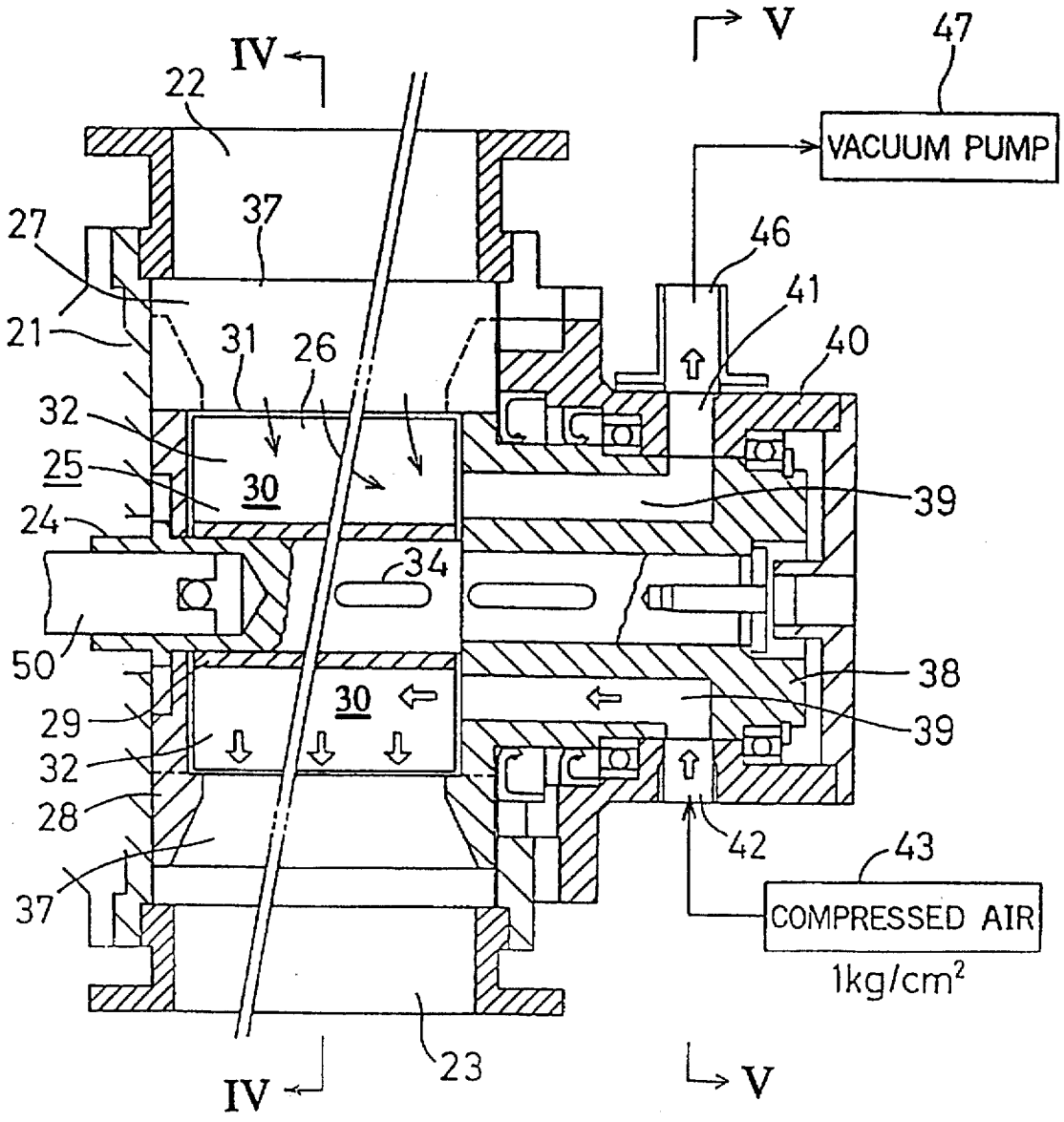
FIG. 3 is a cross-sectional view of a volume reducer of the present invention.

With reference to FIGS. 3 to 10, an embodiment of the present invention will be described below. Reference numeral 22 represents an inlet provided at the top of a cylindrical casing 21. To the inlet 22, a hopper or the like loaded with powder material is attached, for example. Reference numeral 23 represents an outlet provided at the bottom of the casing 21. The outlet 23 is linked, for example, to a bag or container to receive the powder material, or to a duct for further transfer.

Figure 6:
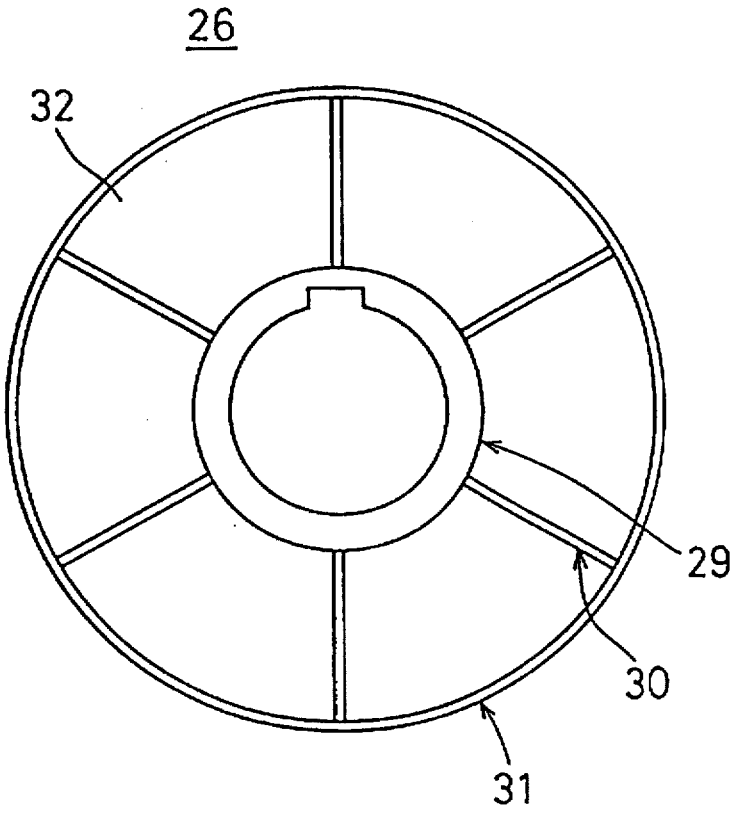
FIG. 6 shows a construction of the filter unit with a porous plate employed in the volume reducer of the present invention.

Near the center of the casing 21, a shaft 24 is disposed through the casing 21. The shaft 24 is provided with a rotor 25. The rotor 25 consists of a filter unit 26, rotor blades 27, and a side plate 28. As shown in FIG. 6, the filter unit 26 consists of a boss 29 which is fixed to the shaft 24, six dividing plates 30, and a porous plate 31. One end of this filter unit 26 is stopped up with the side plate 28, and the other end is stopped up with a rotary valve, which will be described later, to form six inner chambers 32.

Figure 7:
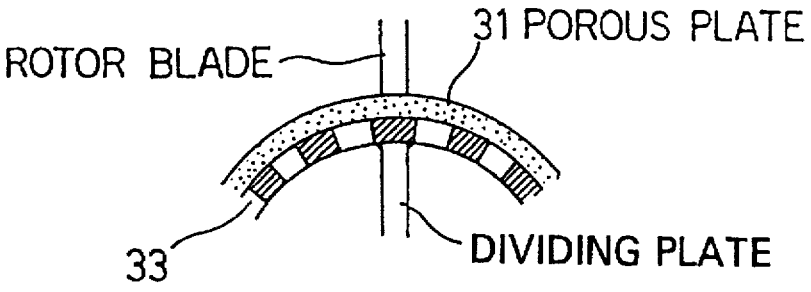
FIG. 7 shows a porous plate with a reinforcement member.

In the porous plate 31, a large number of pores are formed. The porous plate 31 is formed, for example, with sintered stainless steel fiber. It may also be formed with resin or ceramics; if sufficient strength is not secured with these materials, however, a reinforcement member 33 such as wire netting, punched plate, or grating is can be provided on the inner surface of the porous plate 31, as shown in FIG. 7.

Figure 8:
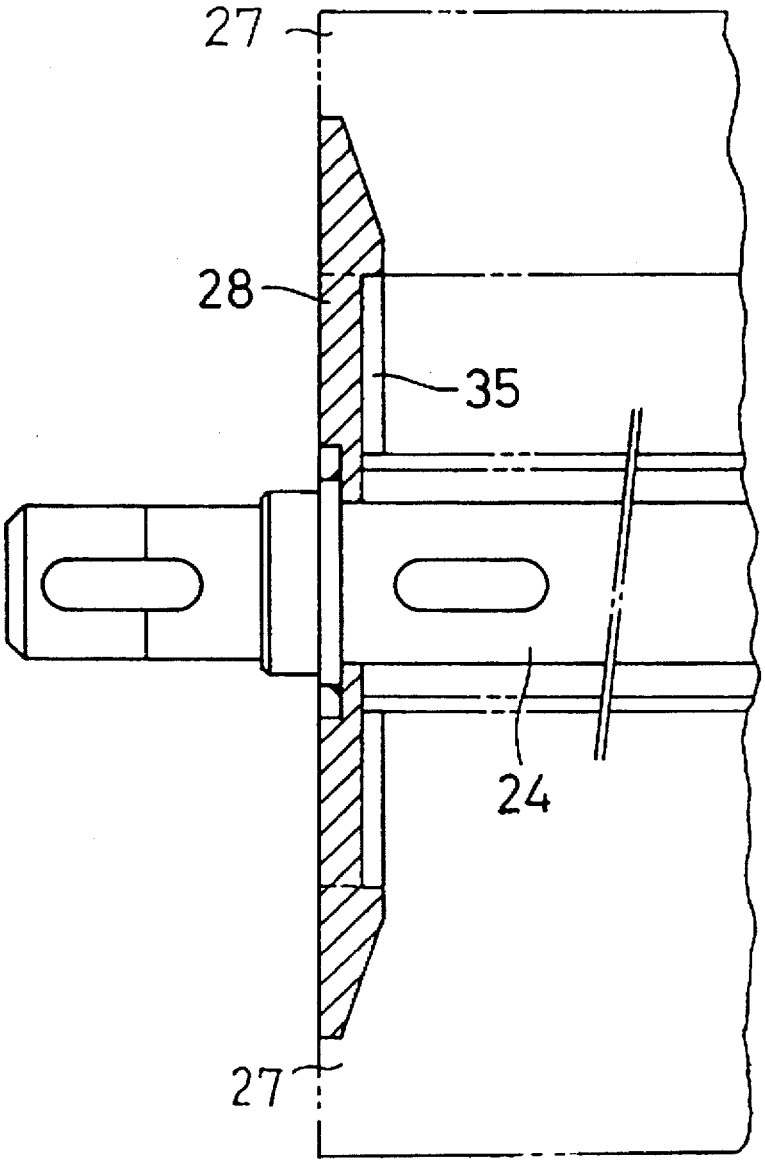
FIG. 8 is a cross-sectional view of the side plate arranged in the volume reducer of the present invention.
Figure 9:
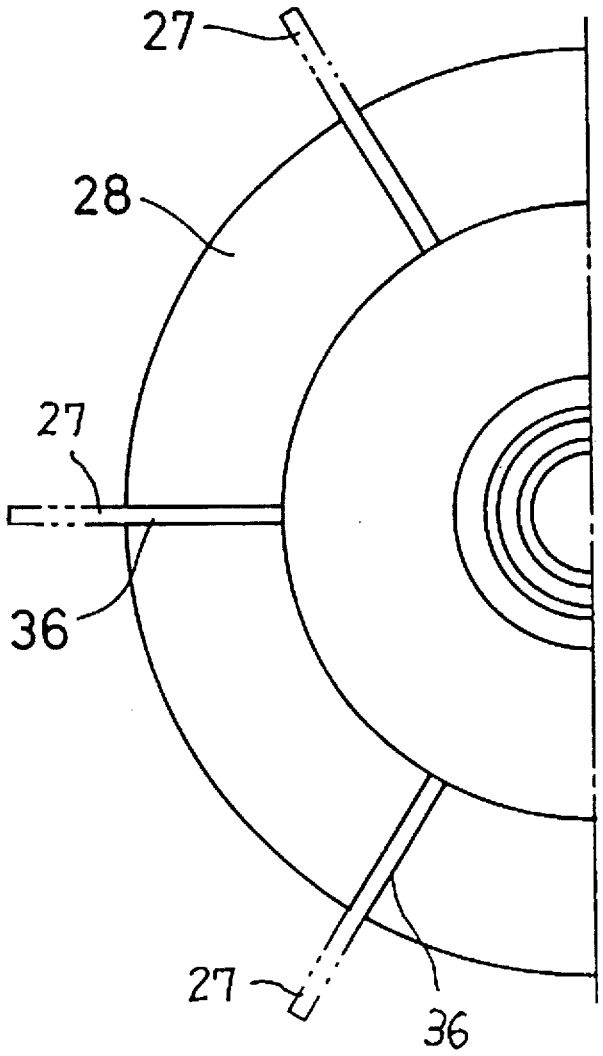
FIG. 9 shows the side plate by half.

The boss 29 of the filter unit 26 is fixed to the shaft 24 with a key lock mechanism 34 comprising a keyway and a key. The side plate 28, which is disk-shaped, is fixed to the shaft 24 as shown in FIG. 8. As described earlier, one end of the filter unit 26 is fitted into a re-entrant portion 35 on the inner side of the side plate 28. As shown in FIG. 9, six radially extending grooves 36 are formed in the side plate 28, so that the ends of the rotor blades 27 are fitted into these grooves 36.

The outer end of the rotor blades 27 slides along the inner surface of the casing 21 keeping absolute contact therewith. Six outer chambers 37 are formed outside the porous plate 31 by the porous plate 31, the rotor blades 27, the side plate 28, and the later described rotary valve. The outer chambers 37 receive powder material 48 at the inlet 22, and release it at the outlet 23.

Reference numeral 38 represents a rotary valve, which is locked on the shaft with a key. The rotary valve 38 is provided with six ventilation openings 39, which communicate at one end with the respective inner chambers 32. The right-hand part of the ventilation openings 39 has a right-angle turning, so that the openings lead to the outside of the rotary valve 38 (in radial directions). The end of the ventilation openings 39 faces a cavity 41 formed in the stationary valve 40. The cavity 41 leads through an exhaust opening 46 to a vacuum pump 47, which is provided externally. The vacuum pump 47 applies a negative pressure to the exhaust opening 46.

Figure 5:
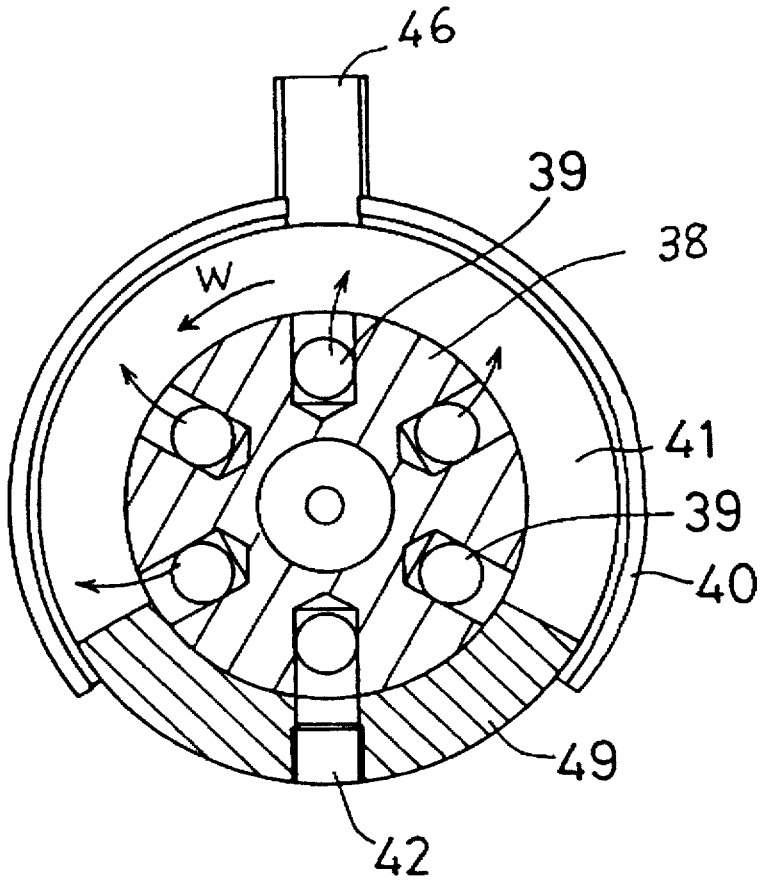
FIG. 5 is a cross-sectional view taken along line V—V shown in FIG. 3.

As shown in FIG. 5, the cavity 41 exists only in a range of 240°, leaving the remaining range of 120° for a stopping wall 49. However, the stopping wall 49 has a compressed air injection opening 42 in its central part, so that, when one of the ventilation opening 39 coincides in position with the injection opening 42, compressed air from a compressed air supply unit 43 flows into the rotor 25 through the rotary valve 38.

Figure 10:
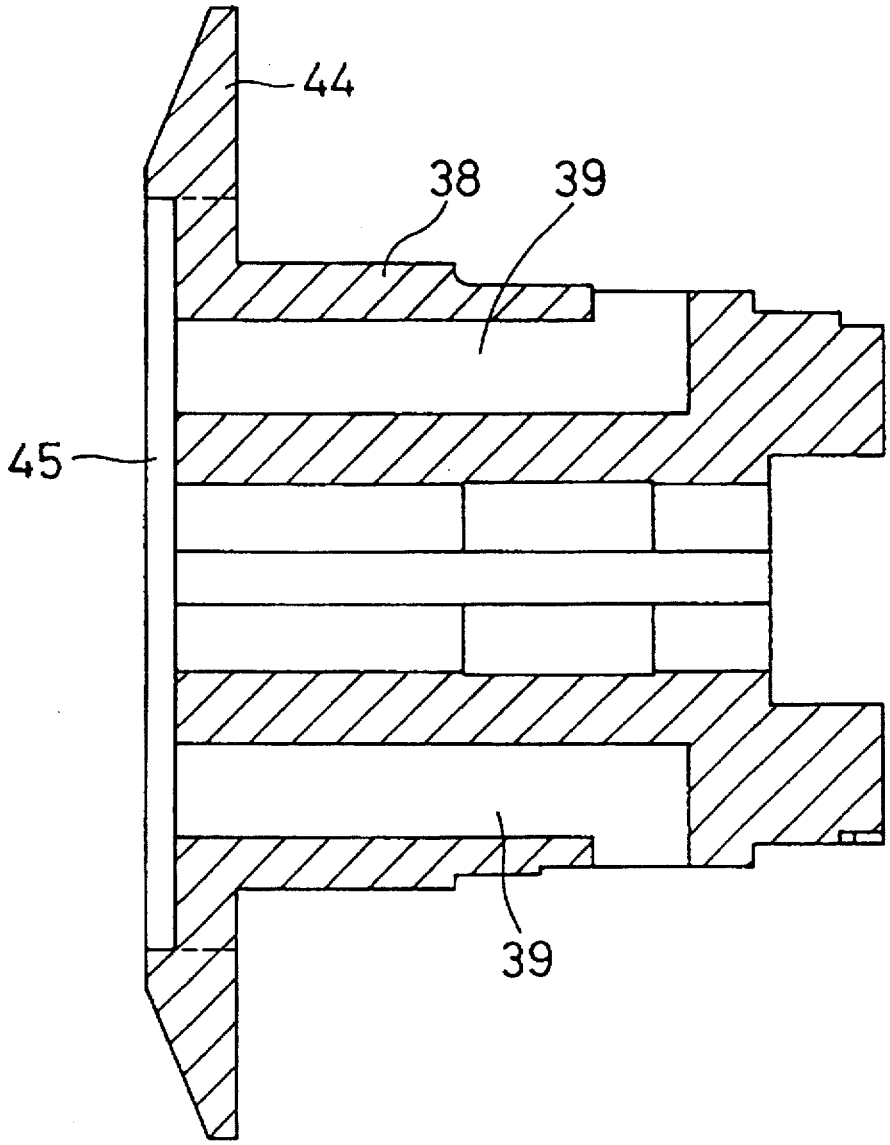
FIG. 10 is a cross-sectional view of the rotary valve arranged in the volume reducer of the present invention.

As shown in FIG. 10, the left-hand end 44 of the rotary valve 38 has the same shape as the side plate 28, and has a re-entrant portion 45, into which the right-hand end of the rotor 25 is fitted. The left-hand end 44 also has slits (not shown in the figure) similar to the slits 36 in the side plate 28 shown in FIG. 9, so that the right-hand ends of the rotor blades 27 are fitted into these slits.

Next, the operation of a volume reducer constructed as described above will be described below. As a drive axle 50 and the shaft 24 rotates, the rotor 25 rotates in the direction marked with the arrow W. The powder material 48, which is supplied to each outer chamber 37 through the inlet 22, is exposed to an air flow, which is caused by a negative pressure applied to the exhaust opening 46 by the vacuum pump 47 and which flows from outer chamber 37 through porous plate 31, inner chamber 32, ventilation openings 39, cavity 41 toward exhaust opening 46. As a result, air contained in the powder material 48 is removed.

Figure 4:
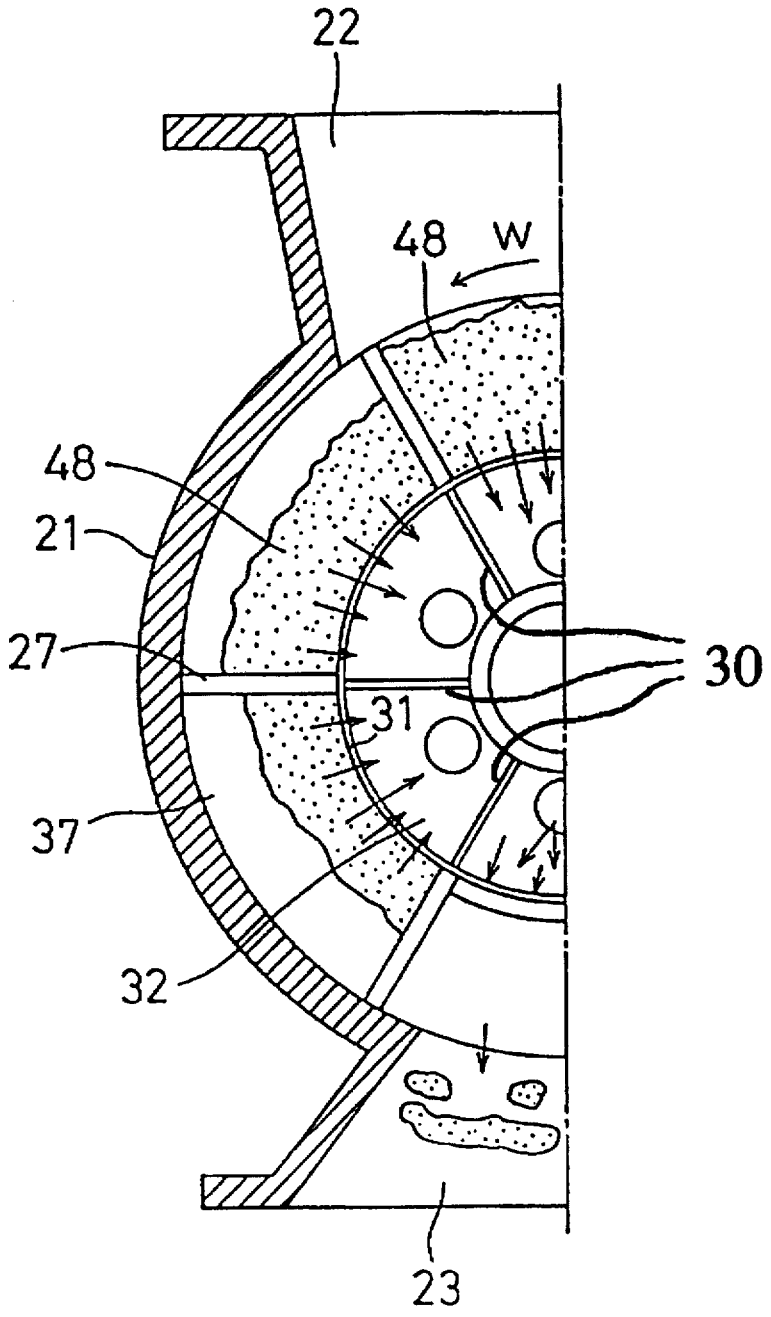
FIG. 4 is a cross-sectional view taken along line IV—IV shown in FIG. 3.

Air removal takes place while the ventilation opening 39 faces the cavity 41. Therefore, as shown in FIG. 4, as the outer chamber 37 moves downward by the rotation of the rotor 25, air removal progresses, reducing the volume of the powder material 48 gradually. While the ventilation opening 39 of the rotary valve 38 faces the stopping wall 49 of the stationary valve 40, air removal does not take place.

When the ventilation opening 39 reaches its lowest position (position corresponding to the position of the exhaust opening 23), the ventilation opening 39 communicates with the injection opening 42. As a result, compressed air acts, through injection opening 42, ventilation opening 39, inner chamber 32 and porous plate 31, on the powder material 48 in the outer chamber 37, pressing the powder material 48 downward. The powder material 48 easily leaves the outer chamber owing not only to its own weight and centrifugal force but also to the pressure of the compressed air, and moves downward through the outlet 23.

When a bag or container is provided at the outlet 23, the powder material 48 is loaded into the bag or container (the bag or container is loaded with the powder material). When a transfer means is provided at the outlet 23, the powder material is transferred to another location by the transfer means. The outer chamber 37, now empty after the discharge of the powder material 48, moves upward with further rotation of the rotor 25 until receiving powder material 48 again at the inlet 22. The operation sequence described above is repeated to deliver volume-reduced powder material successively.

Next, the results of the tests carried out on the volume reducer of the above embodiment with 4 types of powder material will be described below. The table below shows the powder materials used, together with their characteristics. There, the "Powder Density" column is subdivided into three columns: "Loose" for values obtained when materials are sifted and then loaded into containers, "Tight" for values obtained when materials are loaded into containers as much as possible by alternately filling the container with the material and applying a predetermined impact force thereto, and "Dynamic" for values obtained by measuring materials at a predetermined stage of processing.

| Material | Average Particle Diameter (μm) | Powder Density (g/cc) Loose | Tight | Dynamic |
|---|---|---|---|---|
| (1) Foaming Agent | 16.3 | 0.50 | 0.85 | 0.64 |
| (2) White Carbon | 13.18 | 0.11 | 0.17 | 0.13 |
| (3) Aerosol | 5.44 | 0.067 | 0.099 | 0.077 |
| (4) Calcium Carbonate | 5.0 | 0.52 | 0.99 | 0.74 |

Figure 11:
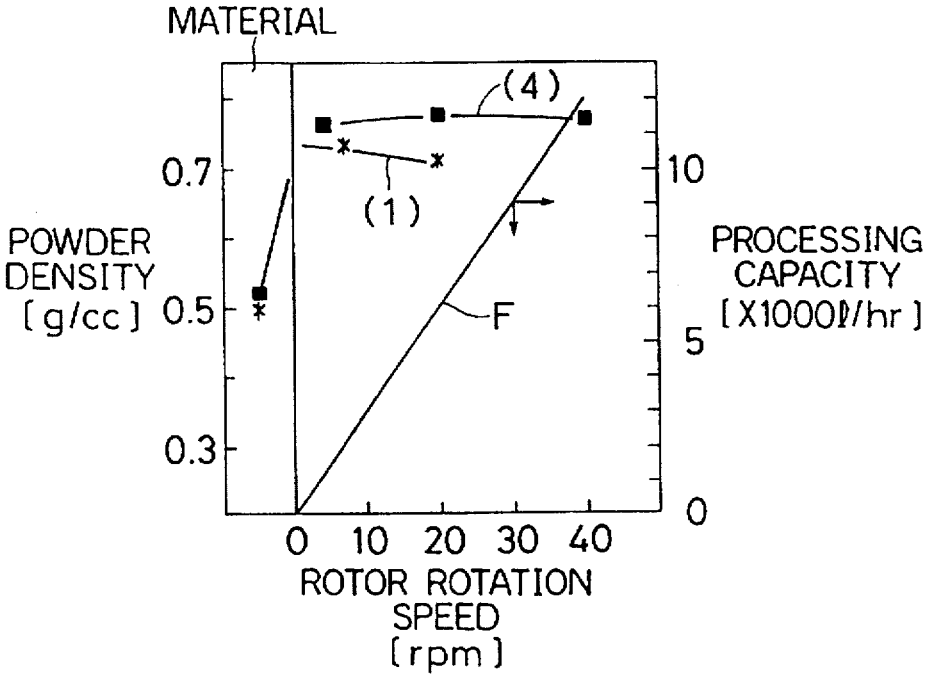
FIG. 11 shows results of the tests carried out with powder materials on a volume reducer embodying the present invention.
Figure 12:
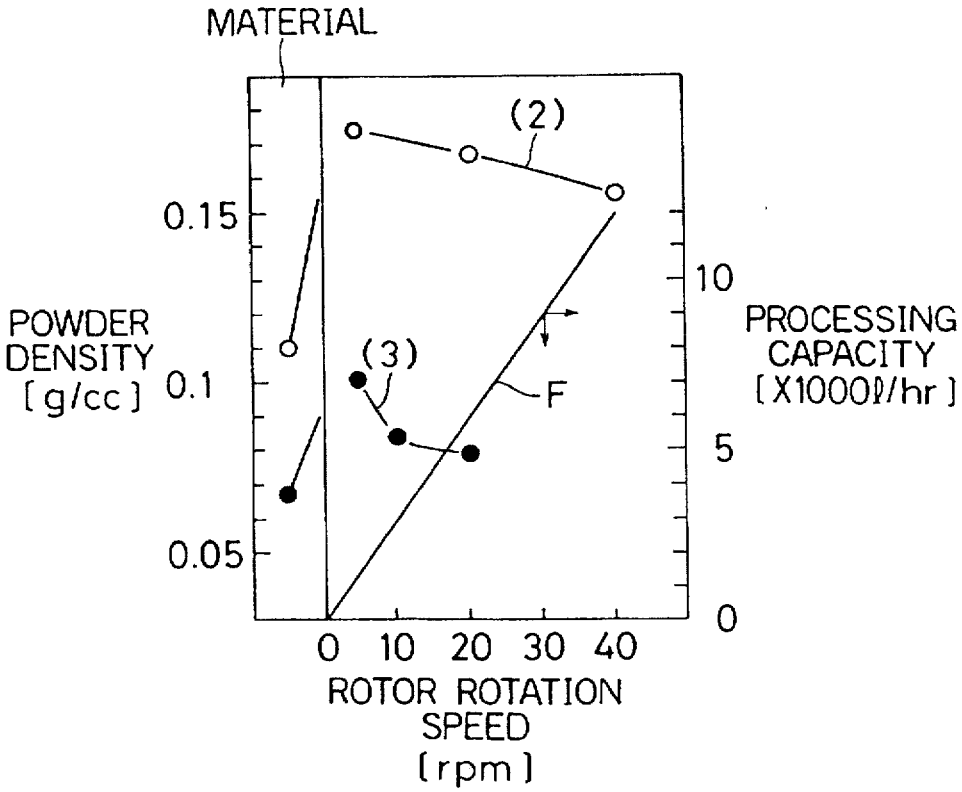
FIG. 12 shows results of the tests carried out with another powder materials on a volume reducer embodying the present invention.

In the tests, a vacuum pump rated at 2 $m^3$/min., −4,000 mmAq was used, and the amount of compressed air used for blowing off powder material was within 100–200 l/min at 1 kgf/$cm^2$. FIG. 11 shows results obtained with foaming agent (1) and calcium carbonate (4); FIG. 12 show results obtained with white carbon (2) and aerosol (3). In FIGS. 11 and 12, the horizontal axis represents rotation speed of the rotor 25, the left-hand vertical axis represents powder density, and the right-hand vertical axis represents processing capacity per hour. In each figure, the line F represents processing capacity characteristic. Incidentally, these tests have shown that it is possible to reduce volume down to about 50 percent.

As described above, according to the present invention, powder material, when conveyed to the discharge position after air removal, is released from the volume reducer without leaving deposit, because the powder material is pressed out of the outer chamber not only by its own weight and centrifugal force but also by compressed air. Moreover, the pressing force can be adjusted to the type of powder material by changing the pressure of air supplied from outside. Further, it is also expected that compressed air is effective in cleaning (removing the clogging of) the porous plate 31. The use of a volume reducer of the present invention is not confined to powder filling machines; it can also be used as a discharger for a dust collector or other particle collector, such as a cyclone, in a compressed-air transfer line, or can be incorporated into a powder material processing machine, such as crusher, dryer, mixer, or granulator, to improve efficiency of supplying and discharging materials and products.

What is claimed is:

1. A volume reducer comprising:

a cylindrical casing having at its top an inlet for letting in powder material and having at its bottom an outlet for letting out the powder material;

a filter unit operable with a rotor rotatable about a center axis of a shaft of said casing, said filter unit provided with a porous plate and inner and outer chambers within the casing divided by said porous plate, the outer chamber being loaded with the powder material;

a rotary valve rotatable together with said rotor, the valve provided with a plurality of ventilation openings communicating with said inner chamber in an axial direction;

a stationary valve embracing said rotary valve such that the rotary valve rotates in sliding contact with said stationary valve, said stationary valve provided with a cavity communicating with said ventilation openings when said rotary valve is positioned within a predetermined range of its rotation angle, said stationary valve provided with an exhaust opening for connecting said cavity to outside; and a compressed air injection opening provided on said stationary valve for receiving compressed air from outside and for communicating with one of the ventilation openings when the ventilation opening is rotated to a position corresponding to said outlet.

2. A volume reducer as claimed in claim 1, wherein said rotor comprises a boss fixed to said shaft, a plurality of dividing plates extending radially from said boss to subdivide said inner chamber, said porous plate mounted at top ends of said dividing plates, a plurality of rotor blades extending radially from said porous plate to subdivide said outer chamber, and a side plate for fixing one end of said rotor blades, another end of said rotor blades being attached to an end surface of said rotary valve to be integral therewith.

3. A volume reducer as claimed in claim 2, wherein the porous plate is formed with sintered stainless steel fiber.

4. A volume reducer as claimed in claim 2, wherein said porous plate is formed with a resin, and a reinforcement member is provided on an inner surface of said porous plate.

5. A volume reducer as claimed in claim 4, wherein the reinforcement member is selected from the group including wire netting, punched plate, and grating.

6. A volume reducer as claimed in claim 2, wherein said side plate is disk-shaped and provided with a plurality of grooves extending radially for fitting the rotor blades therein.

7. A volume reducer as claimed in claim 2, wherein said porous plate includes a ceramic component and a reinforcement member provided on an inner surface of said porous plate is selected from the group including wire netting, punched plate, and grating.

8. A volume reducer as claimed in claim 1, wherein an exhaust pump is connected to the exhaust opening of the stationary valve.

9. A volume reducer as claimed in claim 1, wherein the porous plate is substantially cylindrical.

* * * * *